United States Patent [19]

Yokota et al.

[11] Patent Number: 4,856,754

[45] Date of Patent: Aug. 15, 1989

[54] CONCRETE FORM SHUTTERING HAVING DOUBLE WOVEN FABRIC COVERING

[75] Inventors: Takayoshi Yokota, Kodaira; Shigekazu Horiya, Sagamihara; Sadao Uno, Chiba; Kozo Katayama; Daijiro Tanabe, both of Tokyo, all of Japan

[73] Assignee: Kabushiki Kaisha Kumagaigumi, Fukui, Japan

[21] Appl. No.: 202,108

[22] Filed: Jun. 3, 1988

[30] Foreign Application Priority Data

Nov. 6, 1987 [JP] Japan ..... 62-280393
Dec. 4, 1987 [JP] Japan ..... 62-305749

[51] Int. Cl.[4] ..... E04G 9/10; B28B 7/36

[52] U.S. Cl. ..... 249/113; 249/134; 249/141; 249/189; 264/86; 425/84

[58] Field of Search ..... 249/13, 33, 113, 134, 249/141, 189; 425/84, 85, 812; 264/86, 87

[56] References Cited

U.S. PATENT DOCUMENTS 2,310,391 2/1943 Brooks et al. ..... 249/189
4,730,805 3/1988 Yokota et al. ..... 249/113

FOREIGN PATENT DOCUMENTS 2175635A 12/1986 United Kingdom ..... 249/113

OTHER PUBLICATIONS

Nikkei New Materials, No. 32, pp. 117–120, Aug. 1987.
IABSE Symposium Report, "Improvement of Surface Quality of Concrete Structures by Unique Formwork", Tanaka et al., distributed in Paris, France, Sep. 1987.
Machida et al., "Studies on Improvement of Concrete Quality By Textile Form Method", *Summaries of Technical Papers of Annual Meeting,* Architectural Institute of Japan, 1986, pp. 1–8, 281–288.
"Development of Textile Form Method In Aseishi--Gawa Dam", *Proceedings of Japan Society of Civil Engineers,* No. 373/VI-5, Sep. 1986, pp. 121–129.
"Textile Form Method", technical brochure of Kumagai Gumi Co., Ltd., Tokyo, Japan, 1986.

*Primary Examiner*—James Housel
*Attorney, Agent, or Firm*—Graybeal, Jensen & Puntigam

[57] ABSTRACT

A shuttering used for forming concrete comprises a plate with a plurality of through holes opening on both its face and reverse, and a double woven fabric consisting of a face tissue which permits passage of water but prevents concrete from passing and a reverse tissue opposed to the face of the plate and relatively displaceable with respect to the face of the plate; the surplus water oozing out of placed concrete flows through gaps formed by the reverse tissue between said plate and the face tissue as well as the through holes of said plate.

7 Claims, 6 Drawing Sheets

CONCRETE FORM SHUTTERING HAVING DOUBLE WOVEN FABRIC COVERING

BACKGROUND OF THE INVENTION

This invention relates to a shuttering used for forming concrete.

Heretofore, there has been a shuttering comprising a plate and two fabrics sewed to each other and covering the surface of the plate. The two fabrics consist of an inner fabric adhered to the surface of said plate and an outer fabric which permits passage of water but prevents concrete from passing (See U.S. Pat. No. 4,730,805).

By using this shuttering, surplus water which has passed through the outer fabric contacting concrete is discharged in large quantities through the gap between the inner and the outer fabrics, so that the ratio of water to cement of the surface layer of formed concrete can be reduced and early removal of the form from concrete can be promoted. Also, the outer fabric prevents passing of part of numerous particulate substances consisting of cement particles, aggregate particles, etc. contained in said surplus water to act as a filter which leaves these between the outer fabric and the formed concrete. The residual particles later form a surface layer of high hardness.

The shuttering is cleaned to remove particulate substances adhered to both the fabrics for reuse after removing the form. The shuttering can be cleaned by jetting water toward the outer fabric, but cleaning away said particulate substances from said inner fabric was too difficult to have a sufficient cleaning effect. Thus, it was unavoidable to reuse a shuttering with said particulate substances not sufficiently removed. When the shuttering is reused, the remaining particulate substances in the inner fabric combine with particulate substances in the surplus water flowing between the inner and the outer fabrics to narrow the gap between both the fabrics, preventing the surplus water from flowing, which reduces the discharge thereof. The particulate substances remaining in the inner fabric accumulate each time the shuttering is reused, which reduces the number of reuses thereof.

Further, because the inner fabric is adhered by adhesive to said plate and the outer fabric is sewed to the inner fabric, the outer fabric hardly follows the settling of placed concrete. In view of this, during curing, there occurs a comparatively large relative displacement between the concrete surface layer adhered to the outer fabric and the deep inner portion of the concrete. This relative displacement is a primary factor to prompt separation of said surface layer from said deep inner portion when the form is removed.

SUMMARY OF THE INVENTION

An object of this invention is to provide a shuttering consisting of a combination of a plate and a fabric with good discharging and filtering performances of surplus water and capable of being more effectively cleaned for reuse.

This invention is featured by having a plate with a plurality of through holes opening on both the face and the reverse thereof; and a double woven fabric attached to the plate to cover the surface thereof, the fabric consisting of a face tissue which permits passage of water but prevents concrete from passing; and a reverse tissue opposed to the face of said plate and relatively displaceable with respect to the surface of said plate.

According to this invention, the reverse tissue of the fabric causes gaps between the plate and the face tissue of the fabric. These gaps can receive in large quantities the surplus water which has passed through the face tissue of the fabric contacting concrete, and the surplus water received in said gaps is discharged through the through holes.

Said face tissue of the fabric permits passage of part of numerous particulate substances consisting of cement particles and fine particles of aggregates but prevents most of them from passing through, leaving them behind as a layer between the face tissue and the concrete. These particulate substances later harden to form a fine surface layer of high hardness of the formed concrete.

Also, since the reverse tissue opposed to said plate is relatively displaceable with respect to said plate, when water is jetted toward said fabric for cleaning the shuttering after removal of the form, the wash water reaching said plate through said face and reverse tissues relatively displaces said reverse tissue with respect to said plate. Said particulate substances adhered to said reverse tissue are shaken off due to the relative displacement of said reverse tissue. Thus, it is possible to reuse the shuttering after sufficiently removing particulate substances adhered to the reverse tissue where cleaning effect hardly reaches. Furthermore, since said fabric is also relatively displaceable on the whole with respect to the face of said plate, said fabric contacting the concrete can elongate following the settling of the concrete during cure of the concrete. Because of this, the relative displacement caused between the surface layer of the concrete contacting said fabric and the deep inner portion of the concrete can be remarkably reduced, thereby preventing separation of the surface layer when the form is removed.

Heretofore, a strong force was required to remove a shuttering whose outer fabric adheres firmly to a formed concrete, and due to this strong removing force, a surface layer adjacent to the top portion of said formed concrete would sometimes be removed while adhered to the outer fabric.

These problems can be solved by using the shuttering of this invention with a fabric, the wefts and warps of the face tissue of the fabric having on one plane flat portions respectively which appear on the face of the fabric. Since the surface area of said fabric is smaller than that of the conventional fabric, the area of which concrete adheres is small. Due to this, the shuttering can be removed by a smaller force, thereby preventing separation of the surface layer of the formed concrete in removing the form. Further, since the tensile force exerted on constituting yarn of said fabric is also small, less damage is done to the constituting yarn. Accordingly, the shuttering can be more durable and reused more often. Further, it makes possible to produce a shuttering of a larger size, i.e., a large area and removable with a relatively small removing force. Using larger shutterings saves time and labor in assembling the shutterings and removing the form. Further, since less concrete adheres to the surface of a shuttering, removing the concrete for reuse of the shuttering can be easily done in a short period of time.

The feature of this invention will become more obvious by the following explanation of the embodiments shown.

DESCRIPTION OF THE PREFERRED EMBODIMENTS

Figure 1:
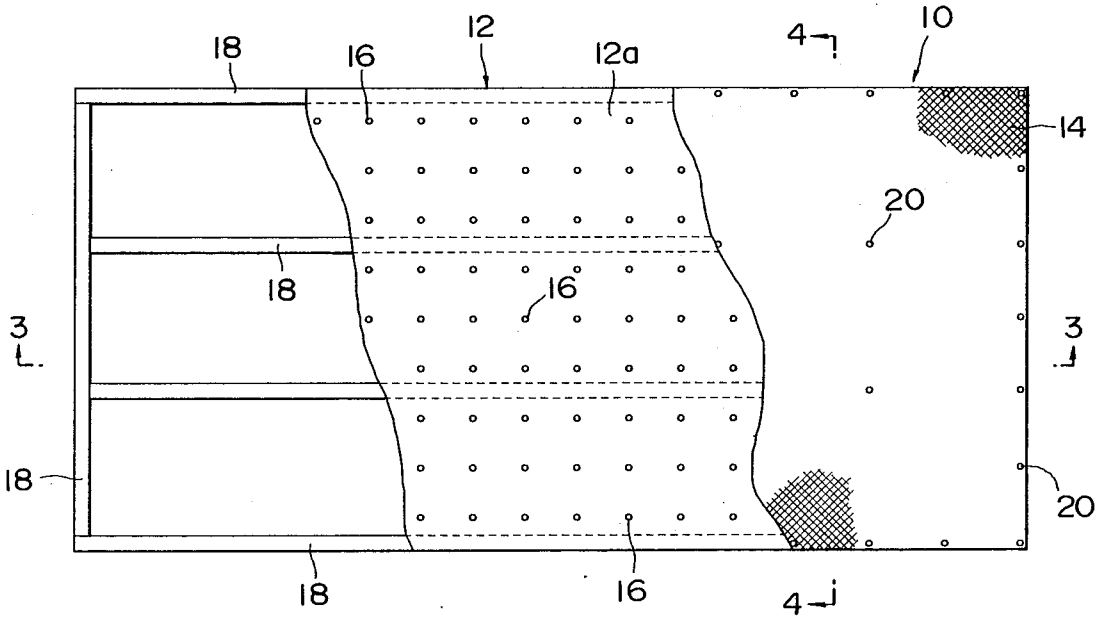
FIGS. 1 and 2 are front and rear elevations showing a shuttering relative to this invention with part thereof cut out, respectively.
Figure 2:
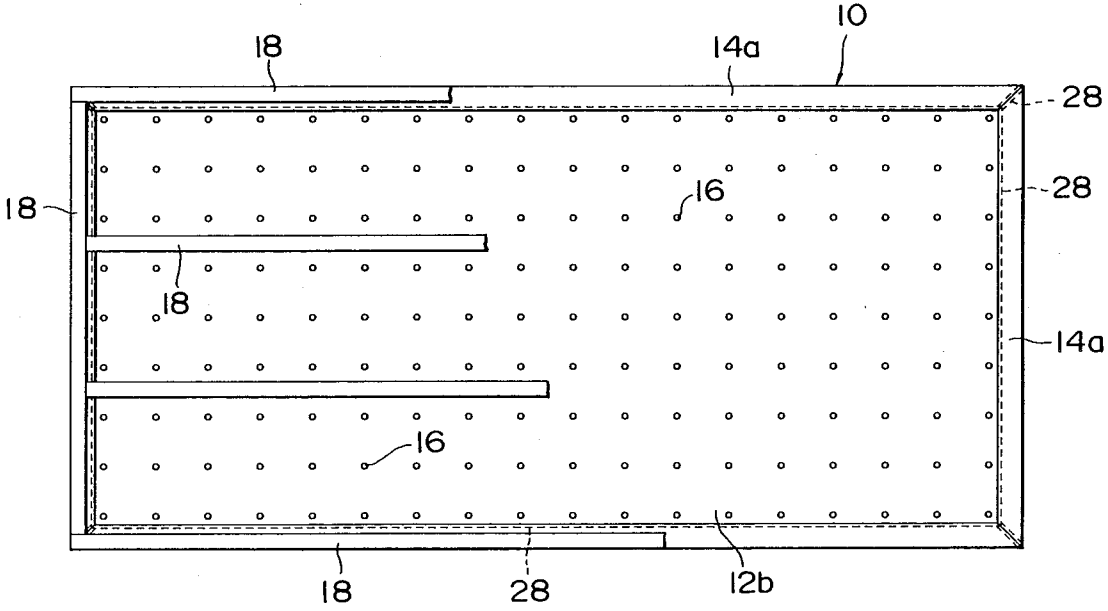
Figure 3:
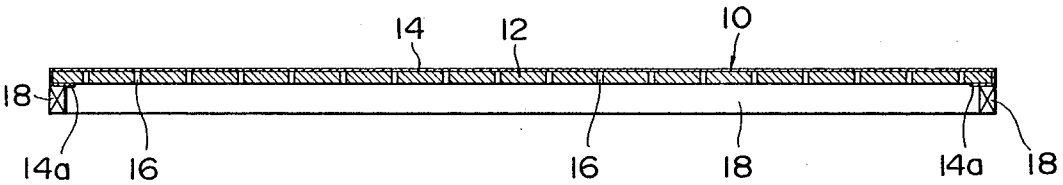
FIGS. 3 and 4 are transverse and vertical sectional views taken along the lines 3—3 and 4—4 of FIG. 1, respectively.
Figure 4:
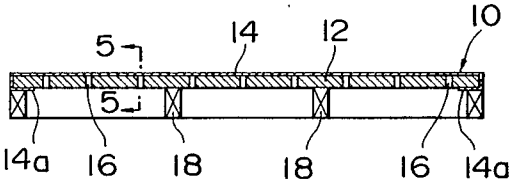

As shown in FIGS. 1 through 5, the shuttering 10 of this invention constituting part of the form for forming concrete comprises a plate 12 having as a whole a rectangular planar configuration, and a double woven fabric 14 attached to the plate to cover the surface 12*a*.

The plate 12 has a plurality of through holes 16 opening on its face 12*a* and its reverse 12*b*. The face 12*a* is preferably smooth. The plate 12 shown is composed of a plywood and an acrylate resin layer coated on one face thereof, the acrylate resin layer giving smoothness to the plate 12. The plate 12 can be composed of metal, plastic plates, etc., besides the one in the embodiment shown. The plate 12 is also reinforced by a plurality of bars 18 respectively extended longitudinally and vertically. Each bar 18 is fixed to the plate 12 by a plurality of driven nails 20 which extend through the fabric 14 and the plate 12 into the bar 18.

Figure 5:
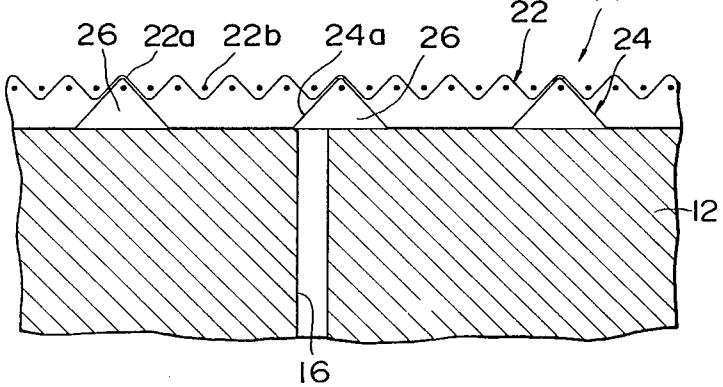
FIG. 5 is a fragmentary sectional view taken along the line 5—5 of FIG. 4 and conceptionally shows the tissue of a fabric.

The double woven fabric 14 consists of a face tissue 22 which permits passage of water but prevents concrete from passing and reverse tissue 24 which is integral with the face tissue 22. The reverse tissue 24 defines, as shown in FIG. 5, a plurality of gaps between the face tissue 22 and the plate 12. Four flap-like edge portions 14*a* communicated to the rectangular portion facing the plate surface 12*a* of the plate of the fabric 14 is folded back toward the reverse 12*b* of the plate and fixed to the reverse 12*b* of the plate in the neighborhood of the edge portions of the plate 12. As a result, the face tissue 22 of the fabric 14 defines the surface of the shuttering 10, i.e., the face abutting against concrete, while the reverse tissue 24 is relatively displaceable with respect to the face 12*a*. The edge portions 14*a* of the fabric can be fixed to the plate 12 by means of staples, tackers 28, etc. or an adhesive (not shown). Also, the operation to attach the fabric 14 to the plate 12 can be done at a construction site where the shuttering is used.

Figure 6:
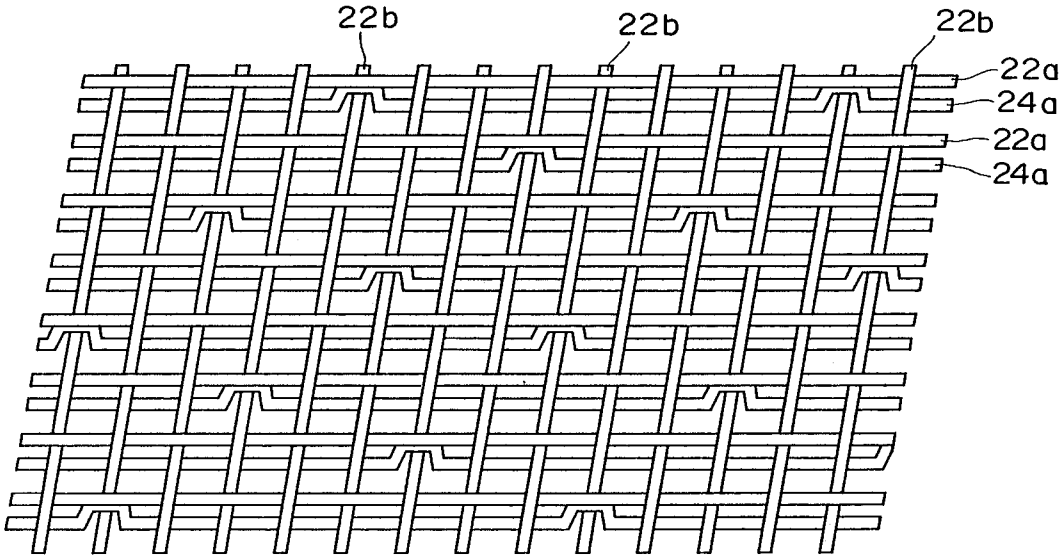
FIG. 6 is a partially enlarged perspective view of the fabric.

An embodiment of the double woven fabric 14 is shown in FIG. 6. The fabric 14 shown is a weft backed woven fabric composed of a face tissue 22 obtained by interlacing a plurality of wefts 22*a* with a plurality of warps 22*b* and the reverse tissue 24 obtained by interlacing the warps 22*b* of the face tissue with other plurality of wefts 22*a*.

The face tissue 22 shown is of a plain weave, and each weft 24*a* of the reverse tissue intersects every eighth warp 22*b* of the face tissue 22, constituting a tissue point together with a warp 22*b*. For wefts 22*a* and warps 22*b* of the face tissue as well as wefts 24*a* of the reverse tissue are used, for example, twisted polypropyrene yarn (1000 deniers), twisted polyester yarn (1000 deniers) and untwisted polyester yarn (960 deniers), respectively. Furthermore, as another example of wefts 22*a*, warps 22*b* and wefts 24*a*, untwisted polyester yarn (1000 deniers), twisted polyester yarn (1000 deniers) and twisted polypropyrene yarn (960 deniers) can be used respectively. Also, the face tissue 22 can be made to have the density of 30 pieces of 1000-denier wefts 22*a* and 36 pieces of 1000-denier warps 22*b* in a one-inch square area.

For the fabric 14 either warp backed woven or warp and weft backed woven can be chosen, according to the need, and for the face tissue satin weave or twill weave can be chosen instead of plain weave shown. Also, warps of the face tissue to co-operate with wefts 24*a* of the reverse tissue to form said tissue points can be chosen at will from among many. Further, it does not matter whether each of wefts 22*a*, 24*a* is twisted or untwisted.

The shuttering 10, when used, is so arranged that the fabric 14 may define a contacting surface with placed concrete. The surplus water which oozes from said concrete gradually flows out through the face tissue 22 of the fabric 14, gaps 26 and then the through holes 16 of the plate 12. The reverse tissue 24 not only functions as a spacer to define the gaps 26, but also acts to lead part of said surplus water from the face tissue 22 to the holes 16 of the plate 12. Each gap 26 defines a passage for the surplus water which has passed through the face tissue 22. The face tissue 22 which prevents concrete, i.e., a mixture of cement particles, aggregates and water from passing acts as a filter to prevent passages of particulate substances consisting of cement particles, fine grain particles, etc. with a particle diameter larger than a gap defined by wefts 22*a* and warps 22*b*. As a result, said numerous particulate substances are left behind in a state of a layer between the shuttering 10 and concrete contacting therewith. These particulate substances harden to form a fine surface layer of a high hardness harder than that of the deep inner portion of the formed concrete.

Since the fabric 14 is relatively displaceable with respect to the surface of the plate 12, the fabric 14 contacting concrete is pulled by the concrete and elongated as the placed concrete settles. As a result, there does not occur such a relative displacement between the surface layer and the deep inner portion of the formed concrete as to separate said surface layer when the form is removed.

The shuttering 10 used for forming concrete can be reused by cleaning after removal of the form. The shuttering 10 can be cleaned by jetting water toward the fabric 14. In passing through the face tissue 22 of the fabric, jetted water washes away said particulate substances adhered to the face tissue. Also, said particulate substances adhered to the reverse tissue 24 are washed away by the pressure of said jetted water which has passed the face tissue 22. Receiving the pressure of said jetted water, the reverse tissue 24 also relatively displaces with respect to the plate 12. This displacement causes particulate substances adhered to the wefts 24*a* of the reverse tissue 24 to be shaken off. The smoother the surface 12*a* of the plate 12 is, the more effective this shaking off is. As a result, most of said particulate substances are removed from the reverse tissue 24 where the cleaning effect can hardly reach. Thereby the amount of said particulate substances accumulating at each use of the shuttering 10 is remarkably reduced, which makes multiple uses of the shuttering possible.

Figure 7:
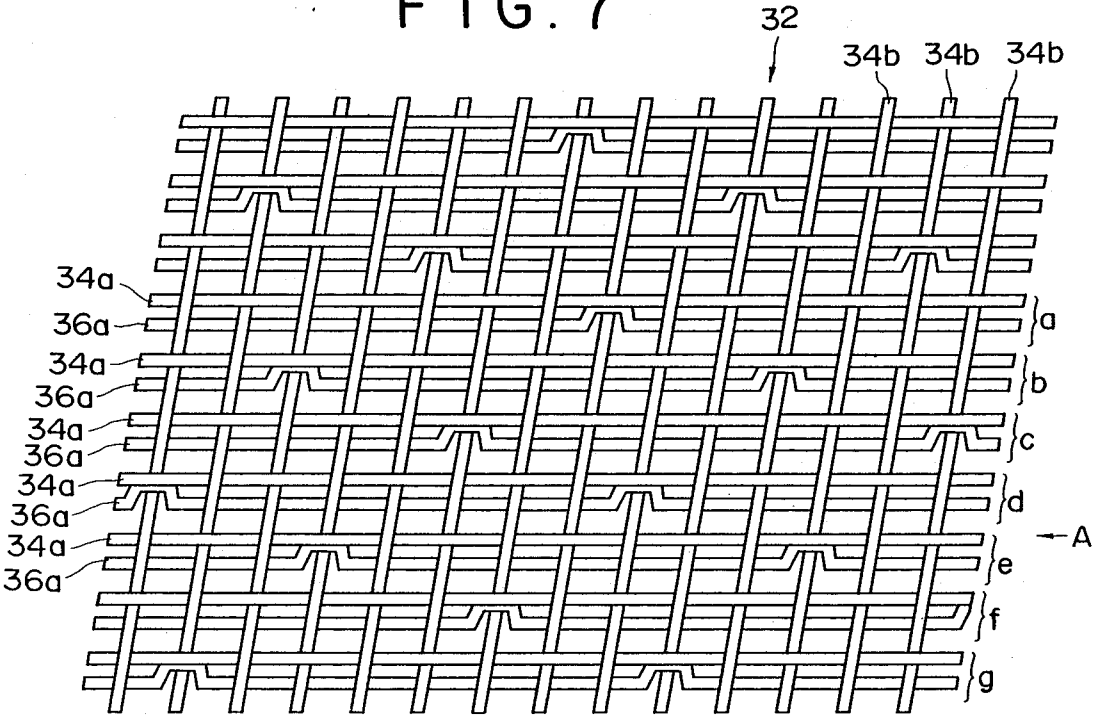
FIG. 7 is a partially enlarged perspective view of another fabric shown similarly to FIG. 6.
Figure 8:
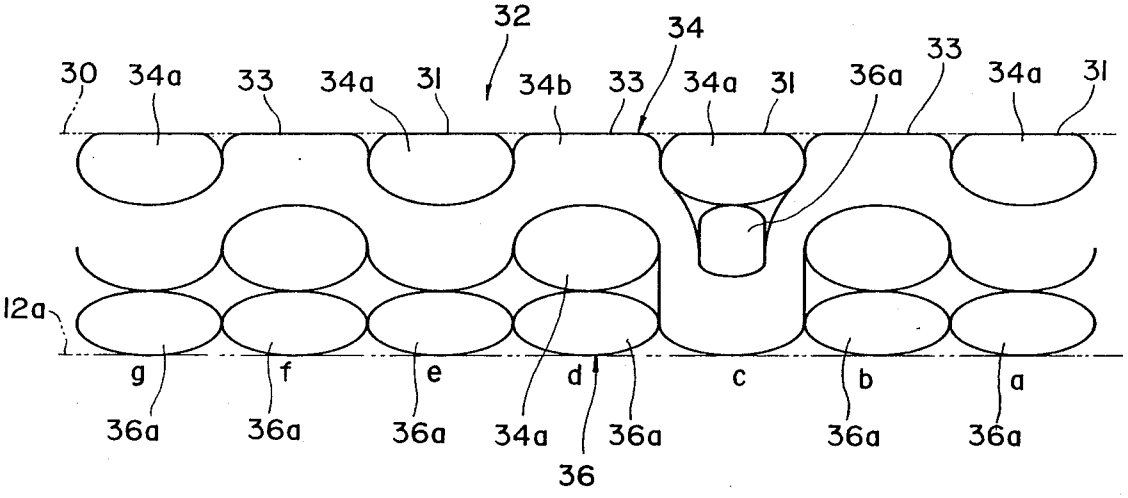
FIG. 8 is a partially enlarged view of another fabric viewed in the direction of the arrow A shown in FIG. 7.

As shown in FIGS. 7 and 8, a double woven fabric 32 having a face tissue 34 can be used. The wefts 34*a* and warps 34*b* appearing on the face of the fabric 32 respectively have flat portions 31 and 33 in one plane 30 (FIG. 8). By this, it is possible to reduce the force in removing the shuttering 10 from concrete. The face tissue 34 is of plain weave, each weft 36*a* of the reverse tissue 36 constituting a weave point with every eighth warp 34*b* of the face tissue while having one-to-one correspondence to a weft 34*a* of the face tissue and being located beneath a weft 34*a* of the face tissue. As regards how the above-mentioned are done, it is clear from FIG. 8 showing the overlapping of yarns in respective rows a–g of both wefts 34*a*, 36*a*.

The flat portions 31 and 33 can be formed, for example, by calendering to pass fabric between a heated and an unheated rollers pressed against each other so that the face and reverse tissues abut against said heated and unheated rollers respectively. As a result of said calendering, curved convex portions of wefts and warps defining the surface of said fabric are plastically deformed, and the plastically deformed faces render flat portions 31 and 33. As is clear from the embodiment of respective rows a–g in FIG. 8, the wefts 34*a* and the warps 34*b* of the face tissue contacting said heated roller are plastically deformed to have a nearly circular to semicircular cross-sectional configuration. Also, the wefts 36*a* of the reverse tissue contacting said unheated roller and the warps 34*a* of the face tissue as well as the wefts 34*b* of the face tissue not contacting the unheated roller are plastically deformed to have a nearly circular to oval cross-sectional configuration.

The surface of the shuttering 10, i.e., the surface of the fabric 32 has a smaller surface area, i.e., the area abutting against concrete, in comparison with the surface before calendering of the fabric, so that the removing force to be applied to the shuttering 10 in removing the form can be reduced.

By constituting at least one of both the wefts and the warps of the face tissue 34 with monofilament yarn, said removing force can be made smaller than when constituting same with multifilament yarn. This is because no such fluffing occurs to monofilament yarn when a portion of filament yarn is cut as is seen in multifilament yarn so that there is no adhesion between said fluff and concrete, and it is not necessary to apply to the shuttering a force to cut off the adhesion between said fluff and concrete.

The fabric 32 is a double woven fabric with twisted polypropylene yarn (multifilament yarn of 1000 deniers), twisted polyester yarn (multifilament yarn of 1000 deniers) and untwisted polyester yarn (multifilament yarn of 960 deniers) respectively as the wefts 34*a* for the face tissue, the warps 34*b* for the face tissue and the wefts 36*a* for the reverse tissue. It can be obtained by calendering a fabric (fabric A) having a face tissue of satin with the texture density of 30 wefts and 36 warps in a one-inch square area under the condition that the surface temperature of the 2.2 m long heated roller is 100° C. and that the pressure load against said fabric is 20 t (20,000 Kg).

The experimental values of the force required to remove a shuttering having a fabric (fabric B) thus obtained from concrete and the force required to remove a shuttering having said fabric A are shown in the following table, though the experimental equipment is not shown.

| | 1st | 2nd | 3rd |
|---|---|---|---|
| Shuttering having fabric A | 58.0 | 135.8 | 137.0 |
| Shuttering having fabric B | 39.5 | 48.1 | 55.6 |
| | | (Unit: kg/m$^2$) | |

Each shuttering used in the experiment is 1 meter in both width and length. Said experimental values are the strengths to remove from the concrete placed in a space defined by one shuttering and three plates disposed and assembled perpendicularly to form a rectangle when on a plane and cured for 48 hours, the area of said shuttering abutting against said concrete being 0.81 m$^2$ (0.9 m$\times$0.9 m). Said strengths of removing forces shown in the table are the maximum values recorded by a pen recorder of the forces received by one horizontal bar when a pantograph jack and an earth pressure cell are disposed between the horizontal bar fixed to the upper end of the shuttering and another horizontal bar fixed to said two plates adjacent to the shuttering. The numerical values in the 1st, 2nd and 3rd experiments of the above table are values obtained respectively in case of a nonused shuttering, in case of reusing said shuttering after the first use and cleaning to wash away cement particles, powdery aggregates, etc. adhered to its surface, and in case of reusing said shuttering after the second use and cleaning.

These results of the experiments prove that the removing force exerted on a shuttering with smooth-surfaced fabric B as a surface-forming material is remarkably reduced in comparison with that of a shuttering with non-smooth-surfaced fabric A.

Also, a face tissue composed of only monofilament yarn before said calendering has coaser meshes than one composed of multifilament yarn, and it is difficult to make them fine, while said calendering can make the meshes extremely fine. Also, ultra-high-molecular-weight polyethylene fiber (the goods name: Dyneema SK60) can be used as yarn composing a face tissue of said double woven fabric. This fiber is excellent in wear-resistance and weather-resistance.

What is claimed is:

1. Shuttering for forming concrete comprising a plate with a plurality of through holes opening on both a face surface and a reverse surface of said plate; and a double woven fabric attached to the shuttering to cover said face surface and having a face against which concrete is formed, said fabric consisting of a face tissue which permits passage of water but prevents concrete from passing and a reverse tissue opposed to the face surface of said plate and relatively displaceable with respect to said face surface of the plate.

2. Shuttering as claimed in claim 1, wherein wefts and warps of the face tissue have flat portions along one plane of the face tissue which appear on the face of the fabric.

3. Shuttering as claimed in claim 2, wherein at least either of the wefts and warps of said face tissue are of monofilament yarn.

4. Shuttering as claimed in claim 1, wherein said fabric is a weft backed woven fabric.

5. Shuttering as claimed in claim 1, wherein said fabric is a warp backed woven fabric.

6. Shuttering as claimed in claim 1, wherein said fabric has a plurality of periphery portions folded back toward the reverse surface of said plate and fixed to said plate.

7. Shuttering as claimed in claim 1, wherein said plate is reinforced by a plurality of bars fixed to said plate by nails penetrating said fabric and said plate.

* * * * *